US011642760B2

(12) United States Patent
Chen

(10) Patent No.: US 11,642,760 B2
(45) Date of Patent: May 9, 2023

(54) WOODWORKING CLAMP HAVING CONNECTOR

(71) Applicant: Chung Li Chen, Taichung (TW)

(72) Inventor: Chung Li Chen, Taichung (TW)

( * ) Notice: Subject to any disclaimer, the term of this patent is extended or adjusted under 35 U.S.C. 154(b) by 0 days.

(21) Appl. No.: 17/656,003

(22) Filed: Mar. 23, 2022

(65) Prior Publication Data

US 2022/0212316 A1 Jul. 7, 2022

(51) Int. Cl.
*B25B 5/16* (2006.01)
*B25B 5/02* (2006.01)

(52) U.S. Cl.
CPC ..... *B25B 5/166* (2013.01); *B25B 5/02* (2013.01)

(58) Field of Classification Search
CPC .... B25B 3/00; B25B 5/02; B25B 5/04; B25B 5/067; B25B 5/082; B25B 5/101; B25B 5/125; B25B 5/068; B25B 5/166; B25B 5/003; B25B 5/102
USPC ..... 269/6, 3, 248
See application file for complete search history.

(56) References Cited

U.S. PATENT DOCUMENTS

2008/0237959 A1* 10/2008 Tseng ..... B25B 5/068 269/86

* cited by examiner

*Primary Examiner* — Lee D Wilson
*Assistant Examiner* — Tyler James McFarland

(57) ABSTRACT

A woodworking clamp having a connector is provided. Two ends of the connector are connected with two clamping members to constitute the woodworking clamp. The connector includes a housing, a receiving tube, a U-shaped buckle, a spring, and a button. When the end of a bar of the clamping member is fully inserted in a notch of the U-shaped buckle, the spring provides a force to return the U-shaped buckle to its original position to complete the locking. When the button is pressed down, that is, a hook of the U-shaped buckle is pressed down, a positioning pin of the bar is released from the receiving tube and the U-shaped buckle so that the bar of the clamping member can be pulled out from the connector.

10 Claims, 10 Drawing Sheets

WOODWORKING CLAMP HAVING CONNECTOR

FIELD OF THE INVENTION

The invention relates to a connector, and more particularly to a woodworking clamp having a connector for increasing the distance between two clamping members of the woodworking clamp. Furthermore, the connector can be mounted to and dismounted from the woodworking clamp with ease.

BACKGROUND OF THE INVENTION

A conventional woodworking clamp comprises a connector, which is able to adjust the clamping distance of the woodworking clamp. Two ends of the connector are provided with a pair of clamping bodies, and the clamping faces of the two clamping bodies face each other to constitute the woodworking clamp. At least one of the clamping bodies is slidable on an adjustable bar, so that the clamping distance of the woodworking clamp can be adjusted. The connector is configured to prolong the distance between the two clamping bodies, so the woodworking clamp can be applied to thicker workpieces.

The installation of the woodworking clamp is achieved by a screw rod inserted in the connector and secured by two sides of the clamping body. When the connector is to be dismounted, it is laborious and time-consuming to remove the screw rod from the clamping bodies.

Thus, the need for improvement still exists.

SUMMARY OF THE INVENTION

It is therefore one object of the invention to provide a woodworking clamp having a connector. Two ends of the connector are connected with two clamping members to constitute the woodworking clamp. The connector comprises a housing, a receiving tube, a U-shaped buckle, a spring, and a button. The housing is composed of a front housing and a rear housing. Two opposing ends of the housing are formed with bar openings, respectively. A top of the housing is formed with a button opening. The receiving tube has two receiving openings at its two ends. The receiving openings are aligned with the bar openings of the housing. A bar of each clamping member is inserted in the receiving tube from a corresponding one of the bar openings. An end face of each receiving opening is recessed inwardly to form a guide groove. The U-shaped buckle has a bottom and two side walls extending upwardly from two sides of the bottom. Upper and lower ends of the spring abut against the housing and the bottom of the U-shaped buckle, respectively. The receiving tube is accommodated between the two side walls. Two opposing ends of each side wall each extend outwardly to form a hook. A notch is formed between the hook and the side wall and aligned with at least one part of the guide groove. The notch and the guide groove are configured to position a positioning pin of the bar. Each side wall has a restricting slot. The restriction slot and a pin hole in a middle portion of the receiving tube overlap for insertion of a restricting pin. The button is accommodated in the button opening and abuts against an outer edge of the button opening. The button spans the receiving tube. A top surface of each side wall of the U-shaped buckle abuts against an underside of the button. The above structural arrangement enables the U-shaped buckle to swing or return to the original position below the button. When the bar of the clamping member is inserted in the bar opening, the bar is in contact with the end face of the U-shaped buckle, so that one end of the U-shaped buckle is inclined downward to enlarge the clamping opening between the notch and the guide groove. When the end of the bar of the clamping member is fully inserted in the notch, the spring provides a force to return the U-shaped buckle to its original position to complete the locking. Similarly, the end of the bar of the other clamping member is also clamped inside the connector. For releasing the engaging state, the button is pressed down, that is, the hook of the U-shaped buckle is pressed down, the positioning pin is released from the receiving tube and the U-shaped buckle so that the bar of the clamping member can be pulled out from the connector.

Preferably, the housing has a guide wall that extends vertically and is adjacent to the button opening. The guide wall is configured to position an end face of the button.

Preferably, the housing has a retaining wall for positioning the receiving tube, so that the receiving tube won't be moved.

Preferably, the housing has a spring positioning portion for positioning the spring. The spring positioning portion may be a groove.

Preferably, the guide groove has a closed end face that is an arc end face for accommodating the positioning pin.

Preferably, the button has a press side and two extension sides extending from the press side. The top surfaces of the side walls of the U-shaped buckle abut against the two extension sides, respectively. Besides, the outer edge of the button opening extends inwardly to form a stop portion. A top of the button is blocked by the stop portion.

Preferably, an end face of the hook is an inclined side. The inclined side is aligned with the bar opening. When the positioning pin of the bar of the clamping member is inserted in the receiving opening from the bar opening, the positioning pin abuts against the inclined side to press down one end of the U-shaped buckle, so as to open the clamping opening smoothly.

Preferably, the receiving tube is a flat tube. An outer contour of the bar corresponds to an inner contour of a part of the receiving tube, so that the bar won't be moved easily when it is connected to the connector.

The above and other objects, features and advantages of the invention will become apparent from the following detailed description taken with the accompanying drawings

and

Figure 5:
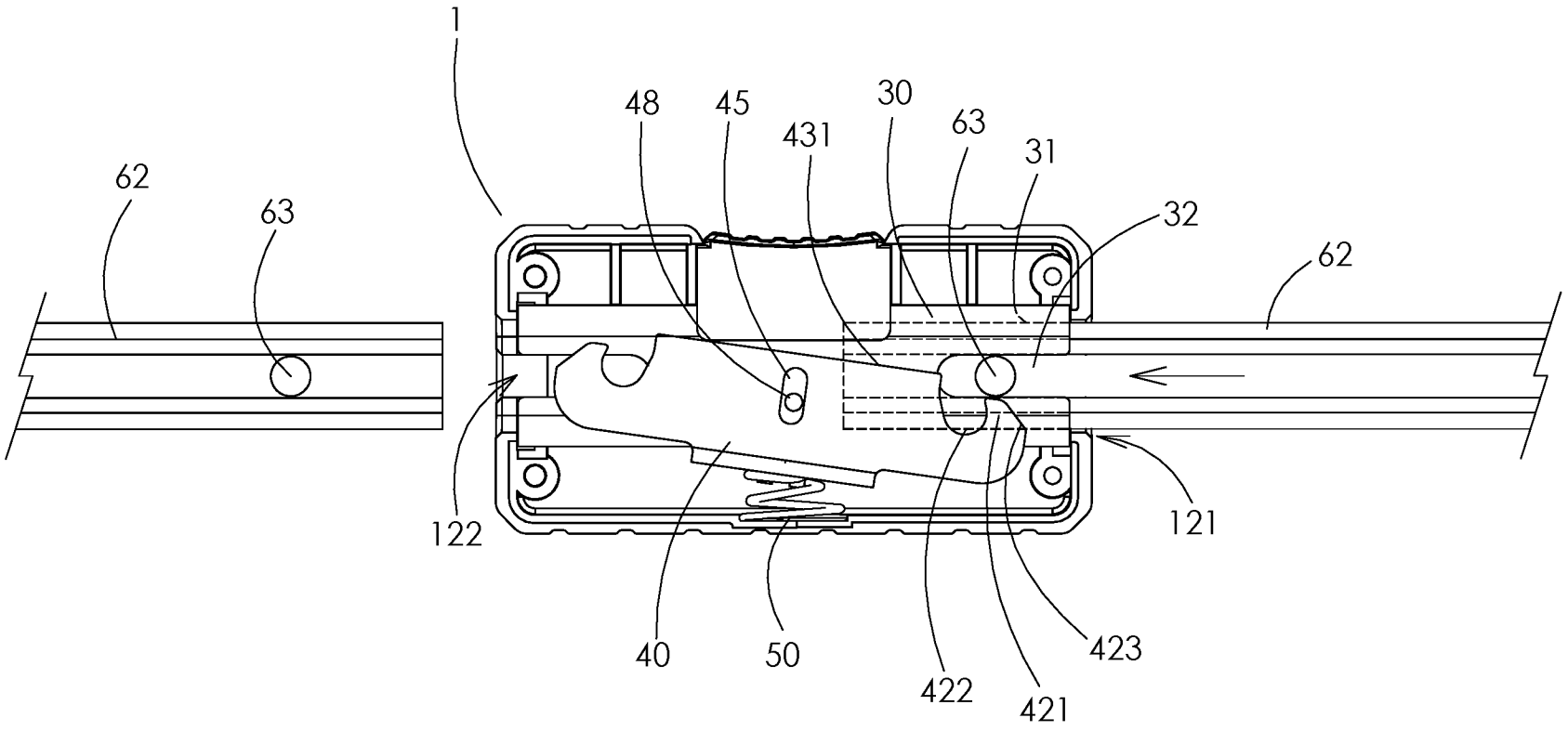
Figure 6:
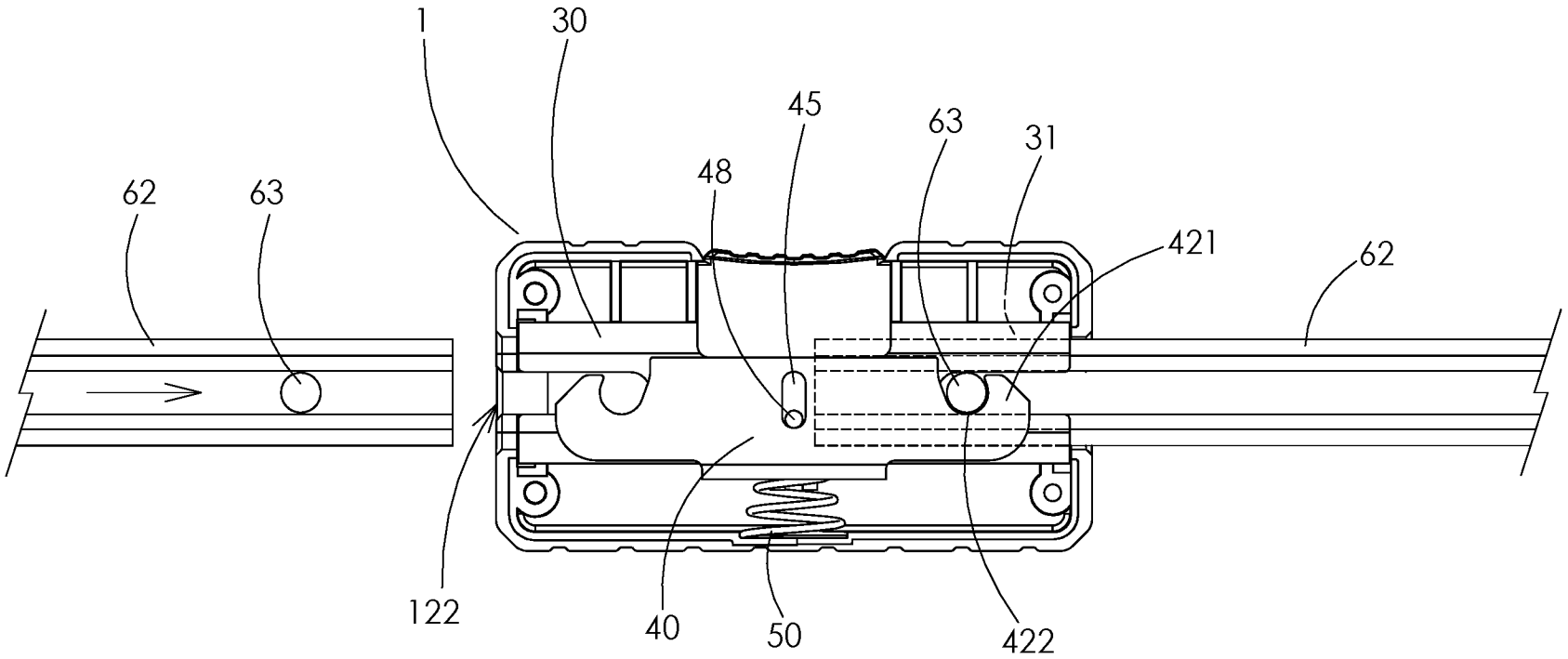
Figure 7:
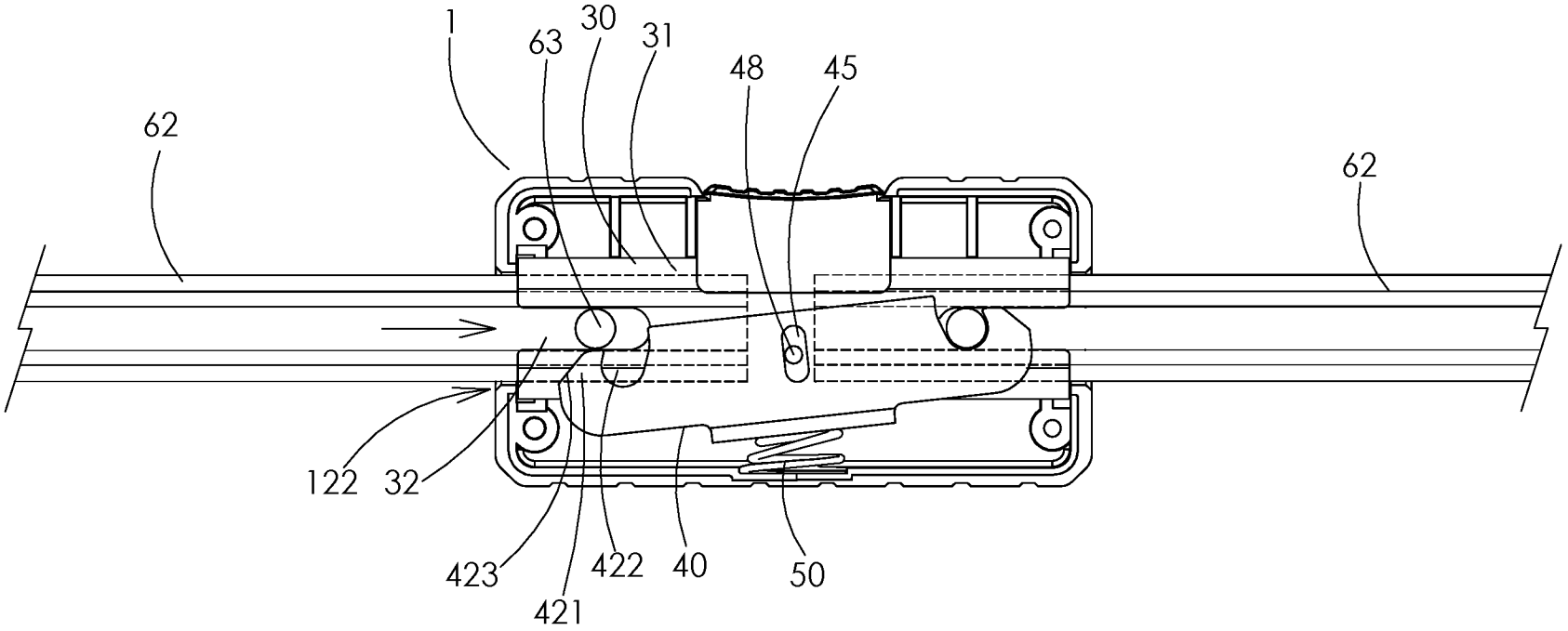
Figure 8:
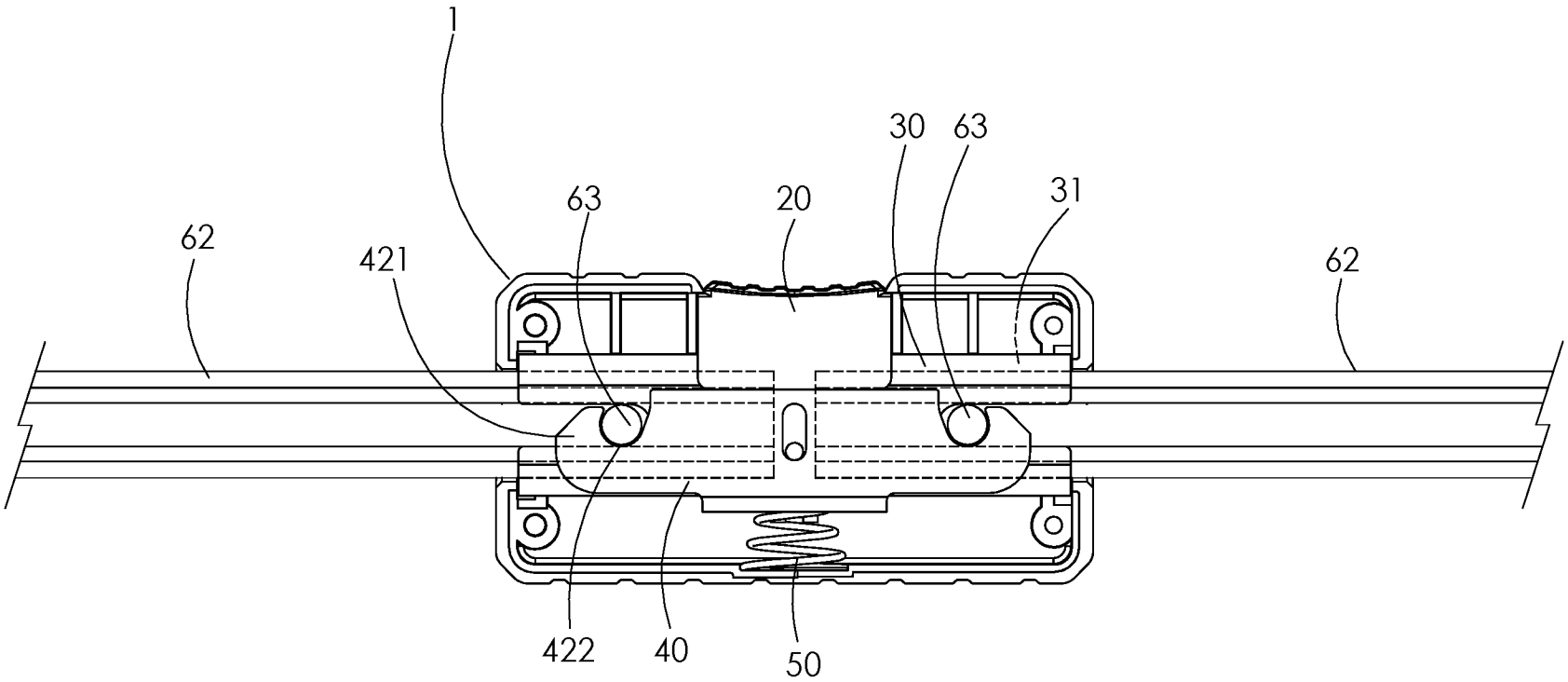
Figure 9:
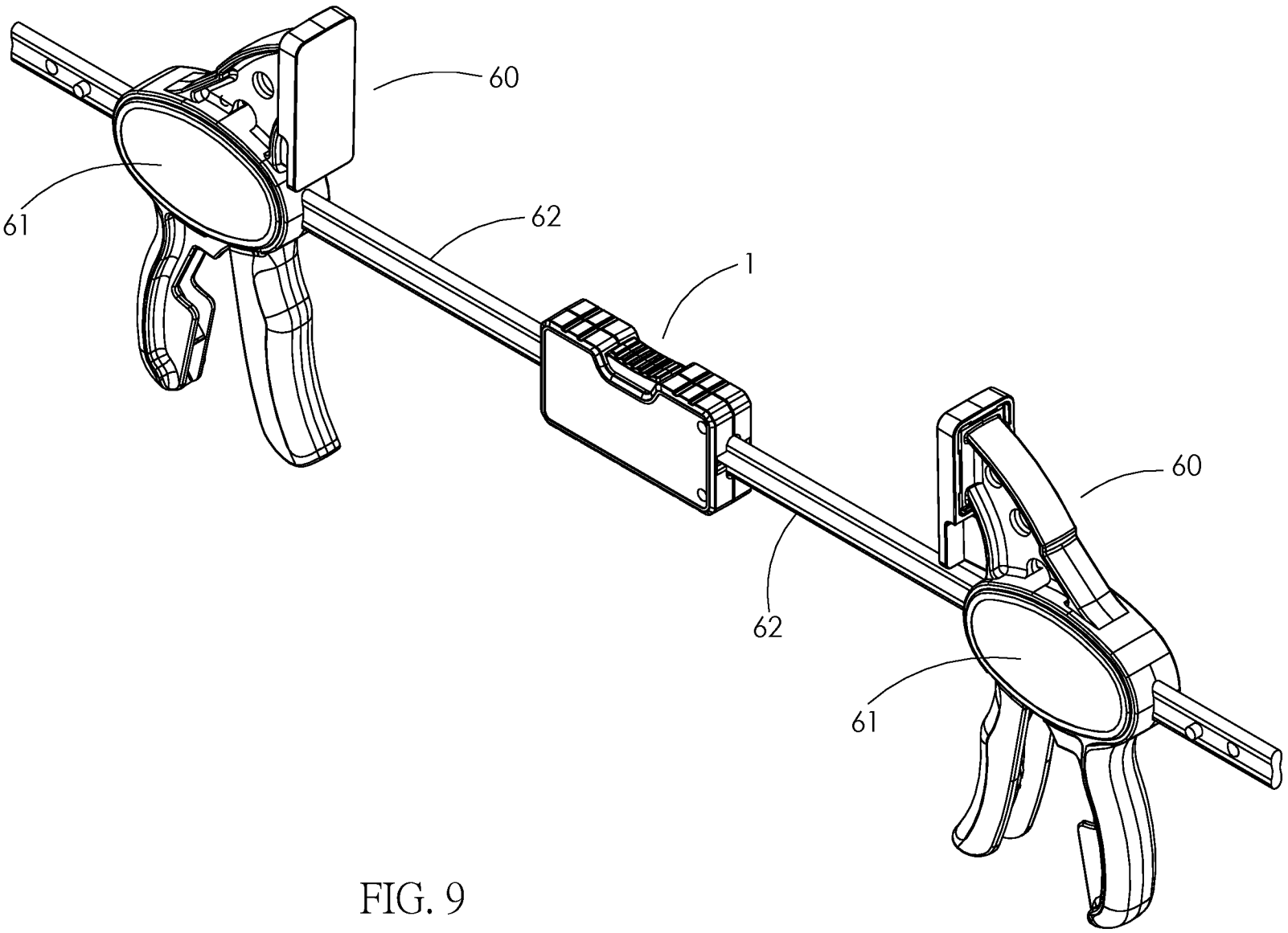
Figure 10:
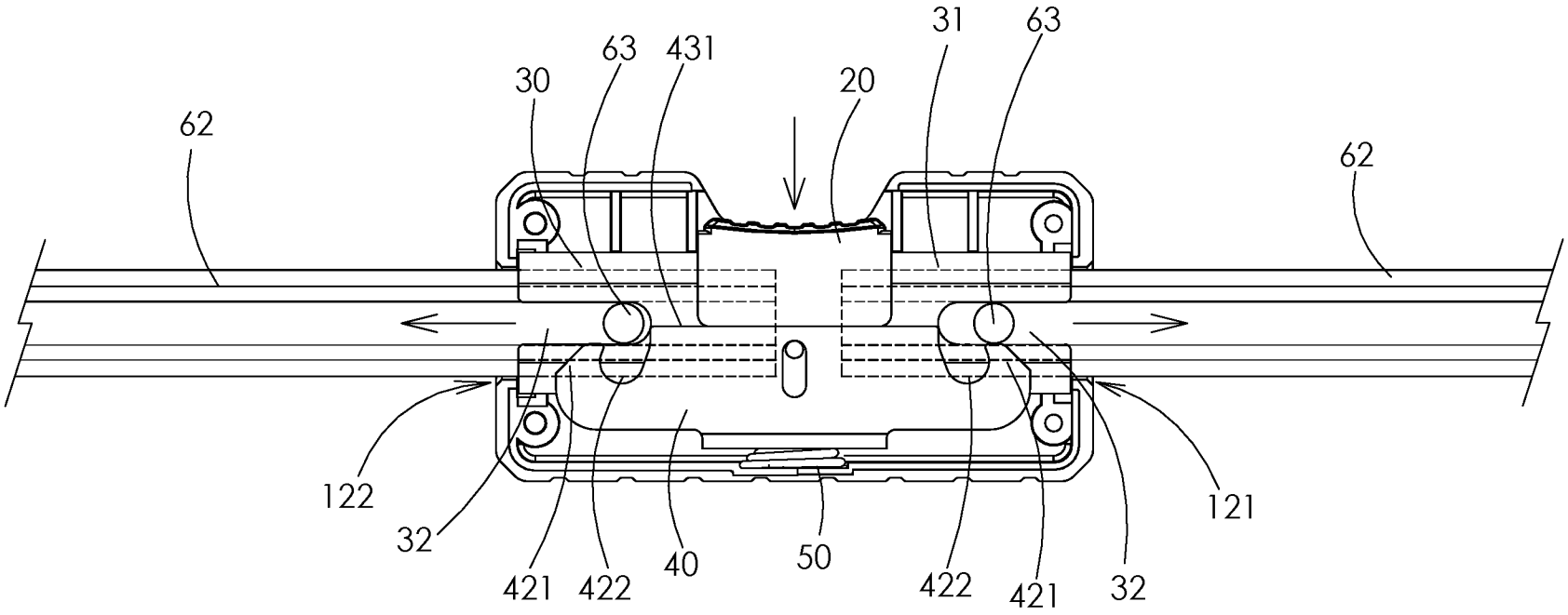

FIGS. 5 to 10 are schematic views showing the installation process of the woodworking clamp respectively.

DETAILED DESCRIPTION OF THE INVENTION

Figure 1:
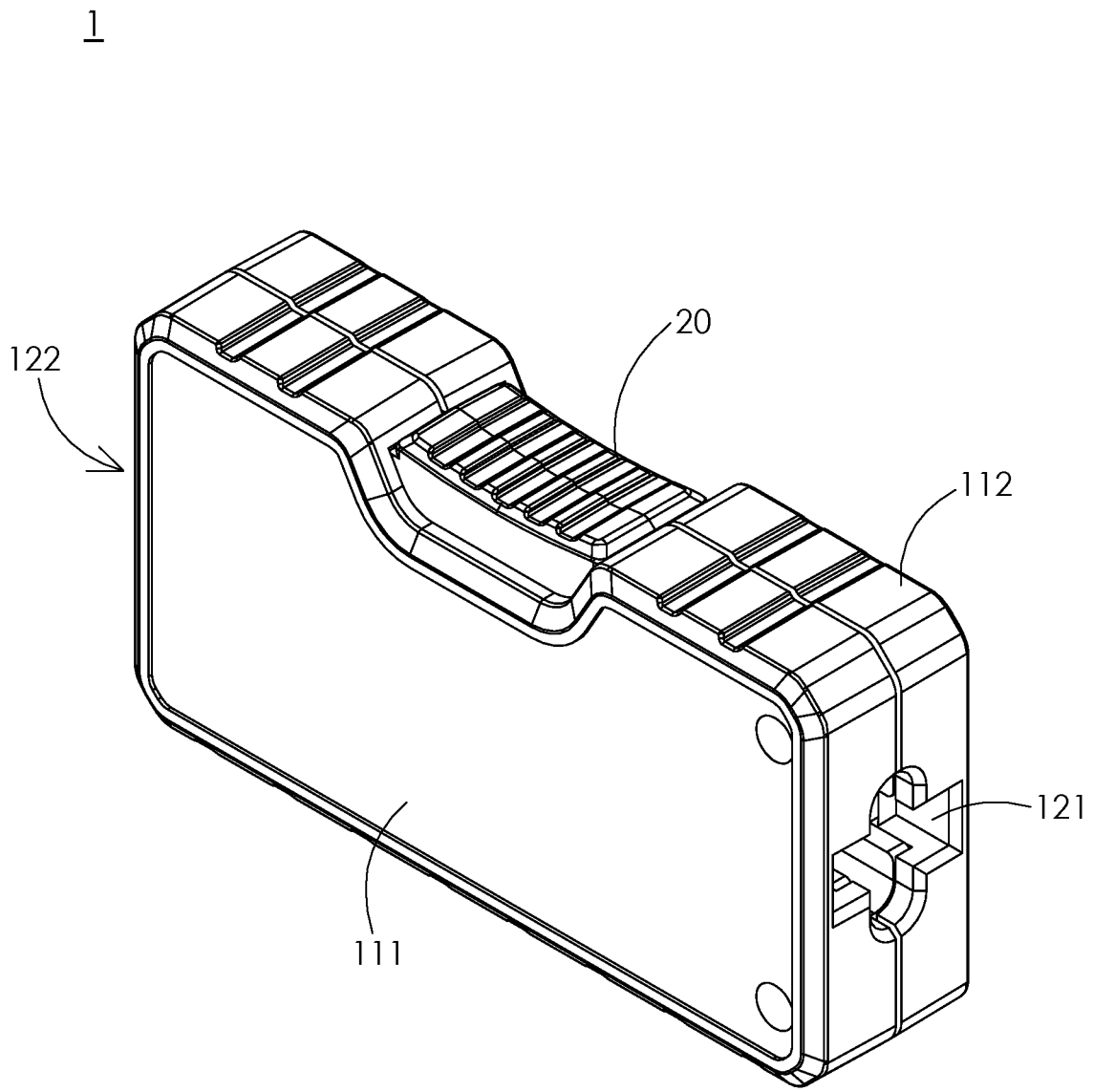
FIG. 1 is a perspective view of the connector of the invention.
Figure 2:
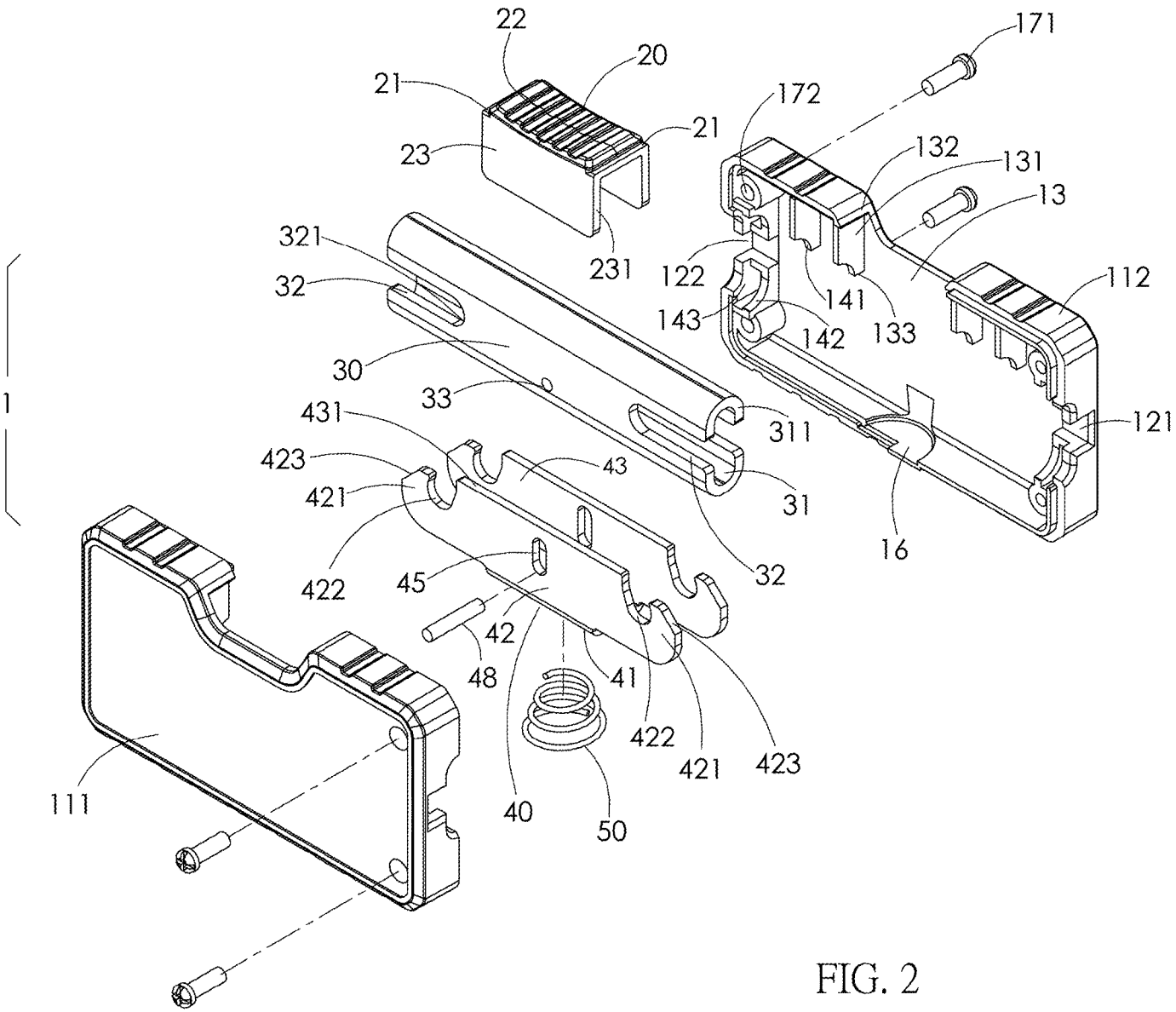
FIG. 2 is an exploded view of the connector of the invention.
Figure 3:
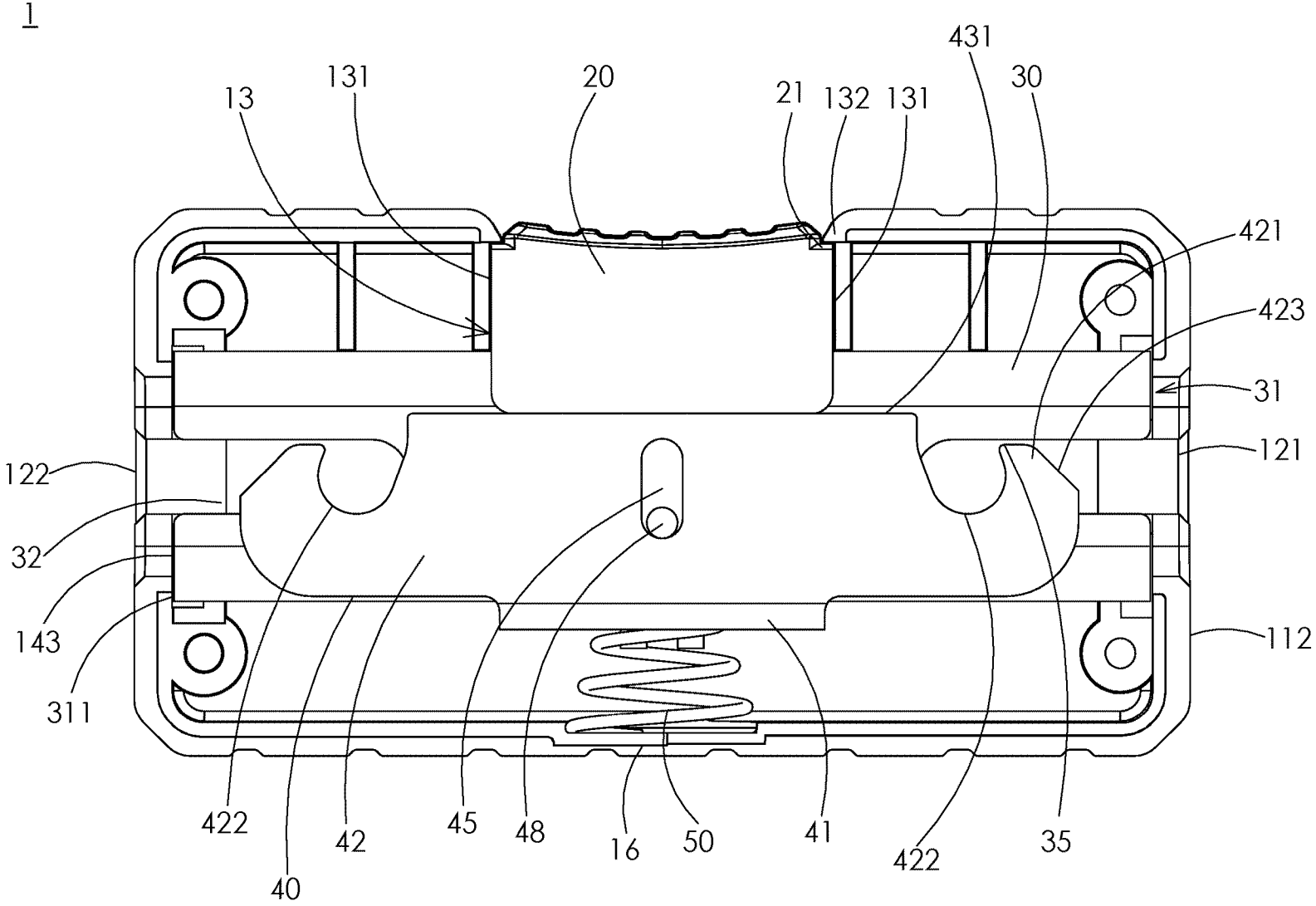
FIG. 3 is a cross-sectional view of the connector of the invention.
Figure 4:
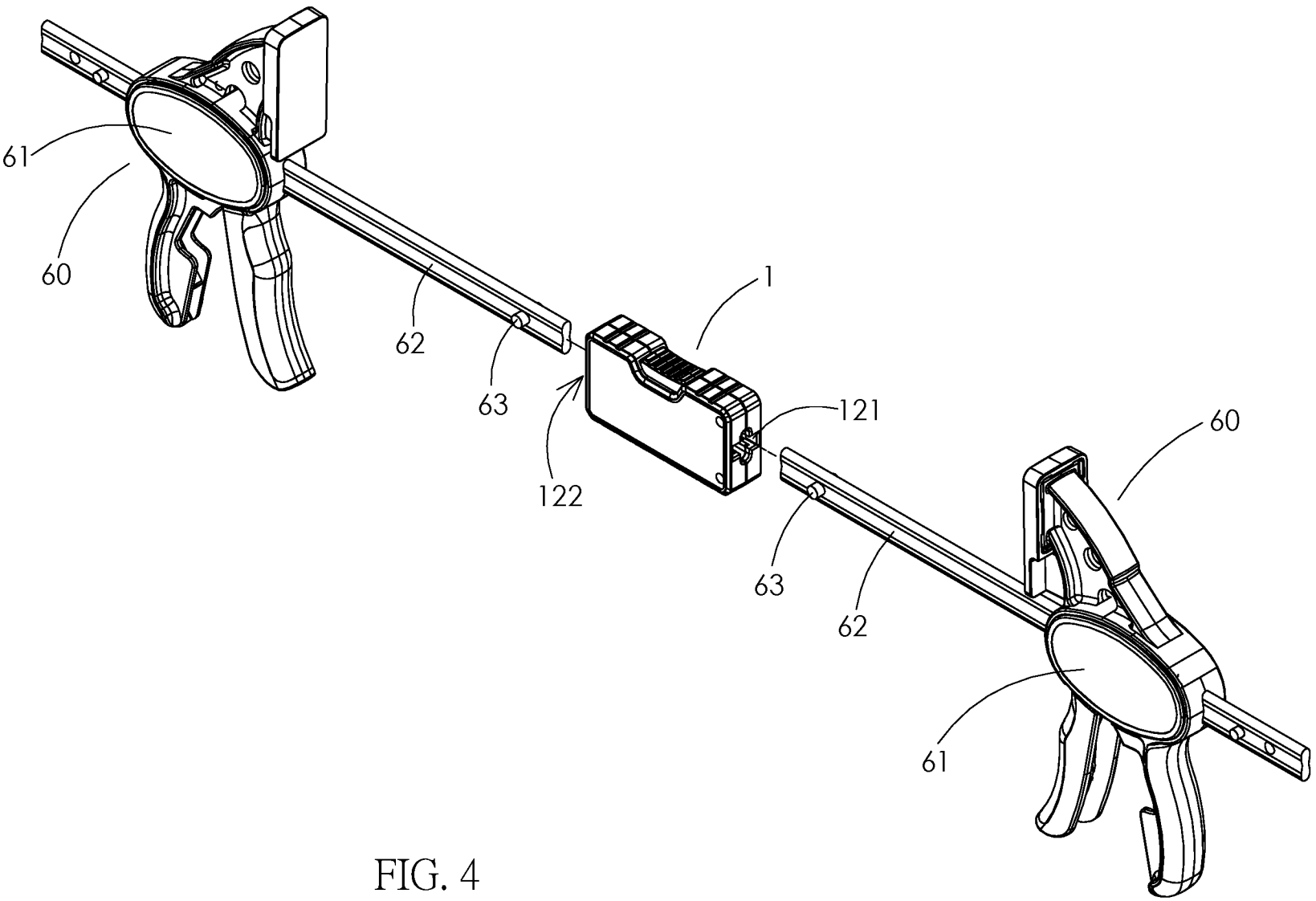
FIG. 4 is an exploded view of the woodworking clamp of the invention.

Embodiments of the invention will now be described, by way of example only, with reference to FIGS. 1 to 10.

The invention discloses a woodworking clamp 60 having a connector 1, which is capable of adjusting a clamping distance. Two ends of the connector 1 are connected with a pair of clamping members 61, and the clamping faces of the two clamping members 61 face each other, so as to constitute the woodworking clamp 60. At least one of the clamping members 61 is slidable on a bar 62, so that the clamping distance of the woodworking clamp 60 can be adjusted. The connector 1 is configured to prolong the distance between the two clamping members 61, so the woodworking clamp 60 can be applied to thicker workpieces.

The connector 1 includes a housing, a button 20, a receiving tube 30, a U-shaped buckle 40, and a spring 50. The button 20, the receiving tube 30, the U-shaped buckle 40 and the spring 50 are arranged sequentially in a top-down direction in the housing. The housing includes a front housing 111 and a rear housing 112. Both the front housing 111 and the rear housing 112 have screw holes 172. Screws 171 are screwed to the screw holes 172, so as to lock and connect the front housing 111 and the rear housing 112. Two opposing ends of the housing are formed with bar openings 121, 122, respectively. The top of the housing is formed with a button opening 13.

The receiving tube 30 is a flat tube. The receiving tube 30 has two receiving openings 31 at its two ends. An end face 311 of the receiving opening 31 is recessed inwardly to form a pair of guide grooves 32.

At least one of the front housing 111 and the rear housing 112 has retaining walls 133, 141, 142, 143 extending inwardly for positioning the receiving tube 30. In detail, the retaining walls 133, 141 are in contact with the arc end faces at the middle portion of the receiving tube 30, the retaining wall 142 is in contact with the arc end face above the receiving opening 31, and the retaining wall 143 is in contact with both end faces of the receiving opening 31 of the receiving tube 30, such that the receiving tube 30 is positioned inside the housing. The receiving tube 30 after being positioned is aligned with the bar openings 121, 122 of the housing, so that the bar 62 of each clamping member 61 can be inserted in the receiving tube 30 from the corresponding bar opening 121/122 and the receiving opening 31.

The U-shaped buckle 40 has a bottom 41, two side walls 42 extending upwardly from two sides of the bottom 41, and an accommodating groove 43 defined between the bottom 41 and the two side walls 42 for accommodating the receiving tube 30. The upper and lower ends of the spring 50 abut against a spring positioning groove 16 on the bottom of the housing and the bottom 41 of the U-shaped buckle 40, respectively. The centers of the button 20, the receiving tube 30, the U-shaped buckle 40 and the spring 50 are arranged in the same straight line.

Two opposing ends of each side wall 42 of the U-shaped buckle each extend outwardly to form a hook 421. A notch 422 facing upwardly is formed between the hook 421 and the side wall 42 and is aligned with at least one part of the guide groove 32. The top surface 431 of the side wall 42 is higher than the top of the hook 421. The top of the hook 421 and part of the guide groove 32 of the receiving tube 30 form a clamping opening 35. Each side wall 42 has a restricting slot 45. The restriction slot 45 and a pin hole 33 in the middle portion of the receiving tube 30 overlap for insertion of a restricting pin 48. The above structural arrangement enables the U-shaped buckle 40 to swing or return to the original position below the button 20. When the bar 62 of the clamping member 61 is inserted in the receiving tube 30, the notch 422 and the guide groove 32 are configured to position a positioning pin 63 of the bar 62.

The button 20 is accommodated in the button opening 13, spans the receiving tube 30, and abuts against the outer edge of the button opening 13. In detail, the button 20 has a press side 22 and two extension sides 23 extending from the press side 22. The top surface 431 of the side wall 43 of the U-shaped buckle 40 abuts against the underside of the corresponding extension side 23. The button 20 is configured to control the engaging state of the receiving tube 30 and the U-shaped buckle 40. When the button 20 is pressed down, the entire U-shaped buckle 40 will be pressed down, the overlapping state of the notch 422 of the U-shaped buckle 40 and the guide groove 32 will be released, and the clamping opening 35 will be enlarged.

It is worth mentioning that as long as the top surface 431 of the side wall 42 of the U-shaped buckle 40 abuts against the underside of the button 20, and the extension side 23 of the button 20 may be in the form of a flat side or a plurality of side-by-side thin rods, the engaging state can be released.

In addition, the outer edge of the button opening 13 extends inwardly to form a stop portion 132. The surface of the press side 22 of the button 20 is reduced inwardly to form a shoulder portion 21. The shoulder portion 21 is blocked by the stop portion 132. At least one of the front housing 111 and the rear housing 112 has a guide wall 131 that extends vertically and is adjacent to the button opening 13. The extending direction of the guide wall 131 is the same as the press direction of the button 20, so that an end face 231 of the extension side 23 of the button 20 can move back and forth along the guide wall 131.

As shown in FIG. 2, FIG. 3, and FIG. 5 through FIG. 10 specifically, when the connector 1 has not yet docked with the bar 62 of the clamping member 61, the spring 50 supports the button 20 and the U-shaped buckle 40 above the spring 50, the receiving tube 30 is retained inside the housing, and the receiving openings 31 are aligned with the rod openings 121, 22, allowing the U-shaped buckle 40 to swing or return to its original position under the button 20.

When the bar 62 of the clamping member 61 is inserted in the bar opening 121, the bar 62 is in contact with the end face of the U-shaped buckle 40, so that one end of the U-shaped buckle 40 is inclined downward to enlarge the clamping opening 35 between the notch 422 and the guide groove 32. When the end of the bar 62 of the clamping member 61 is fully inserted in the notch 422, the positioning pin 63 is positioned by the notch 422 and the surface of the guide groove 32, and the spring 50 provides a force to return the U-shaped buckle 40 to its original position to complete the engagement. Similarly, the end of the bar 62 of the other clamping member 61 is also clamped inside the connector 1.

For releasing the engaging state, the button 20 is pressed down, that is, the hook 421 of the U-shaped buckle 40 is pressed down, the positioning pin 63 is released from the receiving tube 30 and the U-shaped buckle 40, so that the bar 62 and the positioning pin 63 of the clamping member 61 can be pulled out from the connector 1.

In addition, the outer contour of the bar 62 corresponds to the inner contour of part of the receiving tube 30, so that the bar 60 won't be moved easily when it is connected to the connector 1. The guide groove 32 has a closed end face 321 that is an arc end face to match the circular surface of the positioning pin 63 and accommodate the positioning pin 63.

In addition, the end face of the hook 421 is an inclined side 423 which is inclined upward. The inclined side 423 is aligned with the bar opening 121. When the positioning pin 63 of the bar 62 of the clamping member 61 is inserted in the receiving opening 31 from the bar opening 121 or 122, the positioning pin 63 abuts against the inclined side 423 to press down one end of the U-shaped buckle 40, so as to open the clamping opening 35 smoothly.

While the invention has been described in terms of preferred embodiments, those skilled in the art will recognize that the invention can be practiced with modifications within the spirit and scope of the appended claims.

What is claimed is:

1. A woodworking clamp comprising a connector, two ends of the connector being connected with two clamping members to constitute the woodworking clamp, the connector comprising:

a housing, two opposing ends of the housing being formed with bar openings respectively, a top of the housing being formed with a button opening;

a receiving tube, having two receiving openings at its two ends, the receiving openings being aligned with the bar openings of the housing, a bar of each clamping member being inserted in the receiving tube from a corresponding one of the bar openings, an end face of each receiving opening being recessed inwardly to form a guide groove;

a U-shaped buckle, having a bottom and two side walls extending upwardly from two sides of the bottom, upper and lower ends of a spring abutting against the housing and the bottom of the U-shaped buckle respectively, the receiving tube being accommodated between the two side walls, two opposing ends of each side wall each extending outwardly to form a hook, a notch being formed between the hook and the side wall and aligned with at least one part of the guide groove, the notch and the guide groove being configured to position a positioning pin of the bar, each side wall having a restricting slot, the restriction slot and a pin hole in a middle portion of the receiving tube overlapping for insertion of a restricting pin; and a button, accommodated in the button opening and abutting against an outer edge of the button opening, the button spanning the receiving tube, an underside of the button abutting against a top surface of each side wall of the U-shaped buckle.

2. The woodworking clamp as claimed in claim 1, wherein the housing has a guide wall that extends vertically and is adjacent to the button opening, and the guide wall is configured to position an end face of the button.

3. The woodworking clamp as claimed in claim 1, wherein the housing has a retaining wall for positioning the receiving tube.

4. The woodworking clamp as claimed in claim 1, wherein the housing has a spring positioning portion for positioning the spring.

5. The woodworking clamp as claimed in claim 1, wherein the guide groove has a closed end face that is an arc end face.

6. The woodworking clamp as claimed in claim 1, wherein the button has a press side and two extension sides extending from the press side, and the two extension sides abut against the top surfaces of the side walls of the U-shaped buckle, respectively.

7. The woodworking clamp as claimed in claim 1, wherein the outer edge of the button opening extends inwardly to form a stop portion, and a top of the button is blocked by the stop portion.

8. The woodworking clamp as claimed in claim 1, wherein an end face of the hook is an inclined side.

9. The woodworking clamp as claimed in claim 8, wherein the inclined side is aligned with the bar opening.

10. The woodworking clamp as claimed in claim 1, wherein the receiving tube is a flat tube, and an outer contour of the bar corresponds to an inner contour of a part of the receiving tube.

* * * * *